United States Patent [19]

Weaver

[11] Patent Number: 4,574,951

[45] Date of Patent: Mar. 11, 1986

[54] RECLOSABLE PACKAGE

[75] Inventor: Sherry M. Weaver, Chicago, Ill.

[73] Assignee: Champion International Corporation, Stamford, Conn.

[21] Appl. No.: 682,150

[22] Filed: Dec. 17, 1984

[51] Int. Cl.[4] ..... B65D 75/70

[52] U.S. Cl. ..... 206/461; 206/470; 206/625

[58] Field of Search ..... 206/461, 464, 465, 467, 206/468–470, 621, 625, 626

[56] References Cited

U.S. PATENT DOCUMENTS

| | | | |
|---|---|---|---|
| 3,463,309 | 8/1969 | Szostek | 206/470 |
| 3,473,655 | 10/1969 | Keating, Jr. | 206/470 |
| 3,942,640 | 3/1976 | Hellstrom | 206/461 |
| 3,948,391 | 4/1976 | Beaman | 206/461 |
| 4,266,666 | 5/1981 | Kuchenbecker | 206/461 |
| 4,270,659 | 6/1981 | Kuchenbecker | 206/470 |

FOREIGN PATENT DOCUMENTS

| | | | |
|---|---|---|---|
| 0703450 | 2/1965 | Canada | 206/470 |

*Primary Examiner*—George E. Lowrance
*Assistant Examiner*—Jimmy G. Foster
*Attorney, Agent, or Firm*—Evelyn M. Sommer; William W. Jones

[57] ABSTRACT

The package is of the blister variety and includes a paperboard component, a transparent plastic sheet heat sealed to the paperboard component and a plastic blister component. The blister is pivotally connected to the paperboard-plastic sheet composite. A portion of the paperboard plastic sheet composite is secured to the blister to form a latch whereby the package, after being initially opened, can be reclosed. The package can be used for any product which is periodically used and stored between uses in its package.

5 Claims, 4 Drawing Figures

RECLOSABLE PACKAGE

This invention relates to a blister package which is initially sealed and, after being opened for the first time, can be reclosed to store its contents. The package of this invention is a form of a package disclosed in copending application Ser. No. 606,637, filed May 3, 1984 to R. G. Scott.

It is known to package various products in blister packages which allow the product to be seen and which, after being initially opened, can serve to store unused portions of the product. Such packages generally include a plastic blister component and a backing component of a plastic or foil laminated material which allows the package to be hermetically sealed. Separate adhesive-backed printed labels are applied to the package due to the difficulty involved in printing the plastic or foil components directly. Paperboard is much preferred since it can be printed with graphics much easier and more attractively.

When blister packages are used to package foodstuffs, they must be hermetically sealed. Foodstuffs often packaged in blister packages include luncheon meats and sliced cheese. When a paperboard member is used in such a package, the paperboard member must be modified so as to provide an hermetic seal for the package. This is accomplished by heat sealing a sheet of plastic such as polyvinyl chloride or a polyester to the inner face of the paperboard member, as described in the above-noted application Ser. No. 606,637. The blister is then secured to the plastic sheet with a peelable adhesive and with a non-peelable adhesive so as to be pivotable relative to the paperboard-plastic sheet composite. The package can thus be pivoted open and closed.

This invention relates to a variety of such a package wherein the paperboard portion is formed from a one piece blank which is folded upon itself to form a frontal graphics and hanger panel which overlaps a flange formed on the blister. The opposite flange on the blister overlaps the opposite free edge of the blank. A perforated portion of the graphics hanger panel is provided to be grasped and pulled apart to separate the components of the package to initiate opening of the package. The separated portion includes a latching tab which can be brought into engagement with a latching slot on the blank when the package is reclosed whereby the package can be latched after being reclosed.

It is, therefore, an object of this invention to provide a blister package having a paperboard component which is pivotally connected to the blister component to facilitate reclosure of the package.

It is an additional object of this invention to provide a blister package of the character described having a latch tab operable to latch the package in the closed condition.

These and other objects and advantages of the invention will become more readily apparent from the following detailed description of a preferred embodiment thereof when taken in conjunction with the accompanying drawings, in which.

Figure 1:
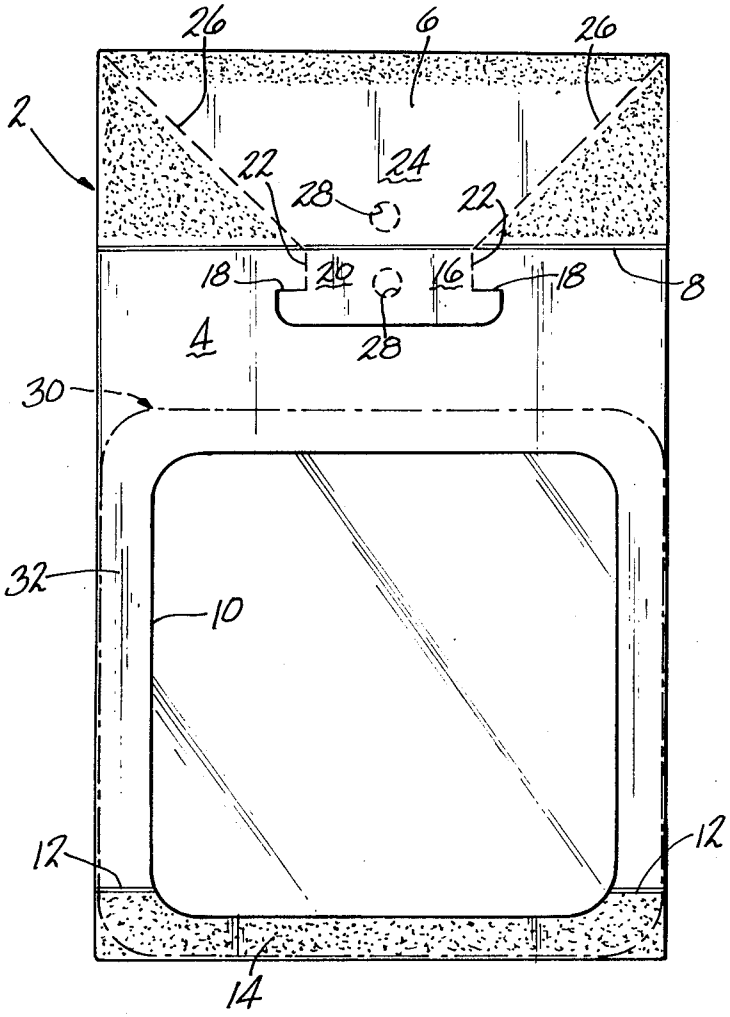
FIG. 1 is a plan view of a preferred embodiment of a cut, scored paperboard blank for forming the paperboard component of the package of this invention.
Figure 3:
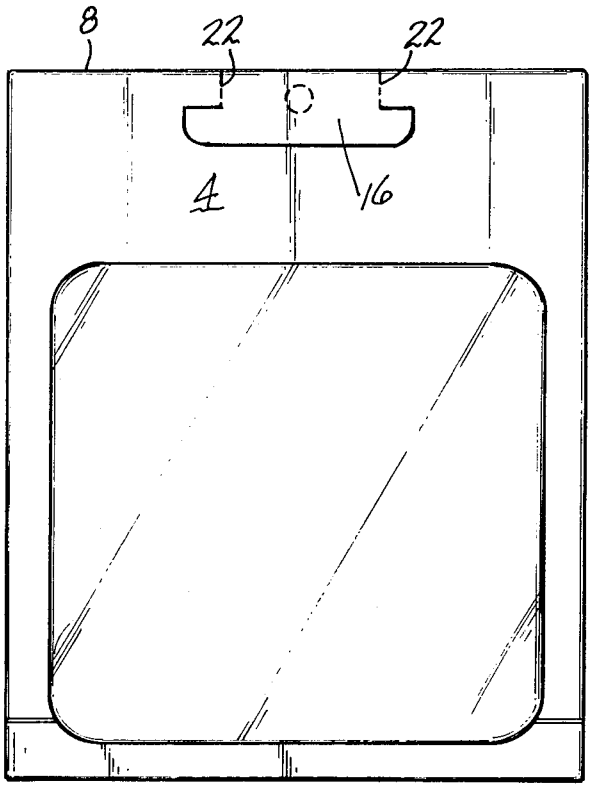
FIG. 3 is a rear elevational view of the package.

Referring now to the drawings, there is shown a cut, scored paperboard blank, denoted generally by the numeral 2, which includes a back panel 4 and a front graphics and hanger panel 6 connected to the back panel 4 by a fold line 8. An opening 10 is formed in the back panel 4 for viewing the contents of the package. This opening can be of any shape and is not meant to be limited to rectangular. A pair of fold lines 12 extend from the sides of the opening 10 to the side edges of the back panel 4 to form a hinge panel 14 at the lower margin of the back panel 4. A latch tab 16 is cut from the top portion of the back panel 4 and includes lateral latching ears 18 and a reduced neck portion 20 bounded by parallel rupturable cut score lines 22 which extend from the ears 18 to the fold line 8 which extends across the neck 20. A tear out panel 24 is formed medially of the graphics and hanger panel 6 and is bounded laterally by a pair of rupturable cut score lines 26 which extend between corners of the free edge of the graphics and hanger panel 6 to the parallel rupturable cut score lines 22. The latch tab 16 is connected to the tear out panel 24 by the central portion of the fold line 8. A pair of hanger openings are formed by the circular arrays of rupturable cut score lines 28, the actual openings being created when the paperboard circumscribed by the cut score lines 28 is punched out to hang the package on a display hanger. The entire front surface of the blank, as viewed in FIG. 1, is covered by a transparent plastic sheet, such as polyvinyl chloride, which is preferably heat sealed to the paperboard blank which has had an opening, 10, die cut beforehand. This plastic sheet converts the paperboard into an hermetically sealable material. All of the scores 22, 26 and the opening 10 are sealed by the plastic sheet. The shaded areas shown in FIG. 1 are coated with a rotogravure printed non-peelable adhesive material, such as a polyamide resin of the type sold by Mobil Oil Company under the trademark Mobil S 9452, and the blister 30, shown in phantom, is secured to the paperboard-plastic laminate by a rotogravure printed peelable adhesive or release coating such as a polyvinylidene resin of the type sold by Dow Chemical Company under the trademark Saran. It will be noted that the blister 30, which can be formed from a plastic material, such as polyacrylonitrile, has a basal flange 32 and the peelable adhesive secures the blister flange 32 to the paperboard-plastic laminate except on the hinge panel 14 where the non-peelable adhesive secures the blister flange to the paperboard-plastic laminate.

Figure 2:
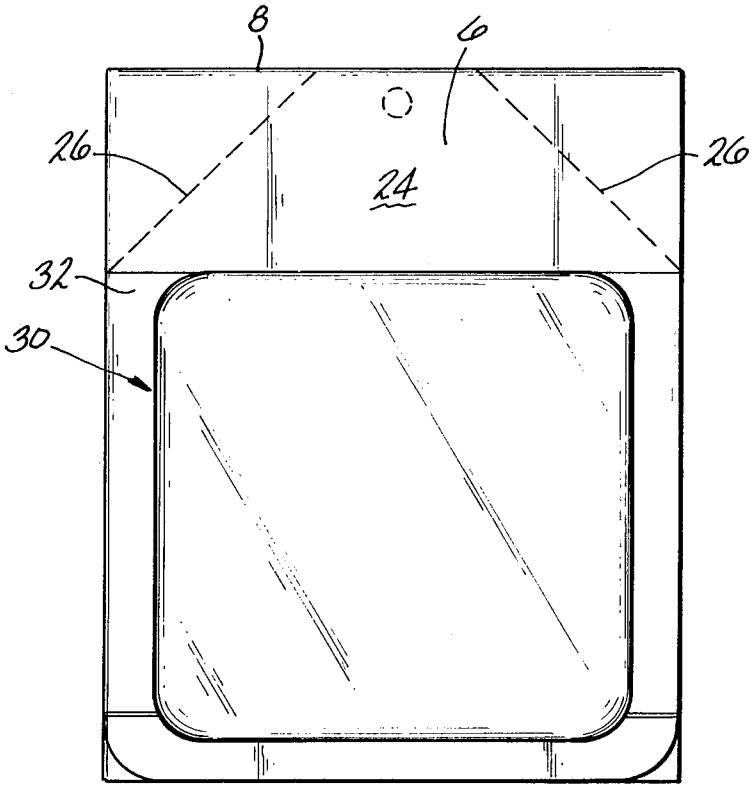
FIG. 2 is a front elevational view of the package.

To fill and close the package, the product is placed into the cavity of the blister component 30 and the paperboard plastic component is placed over the product filled blister and hermetically secured to the back panel 4. The graphics and hanger panel 6 is then folded about the fold line 8 as shown in FIG. 2 so that the triangular areas outward of the cut score line 26 will adhere to the underlying portions of the back panel 4. The lower margin of the tear out panel 24 is likewise adhered to the front surface of the upper leg of the blister flange 32. The latching tab 16 will remain in the plane of the back panel 4 due to the cut score lines 22 and nicks on tab 16.

Figure 4:
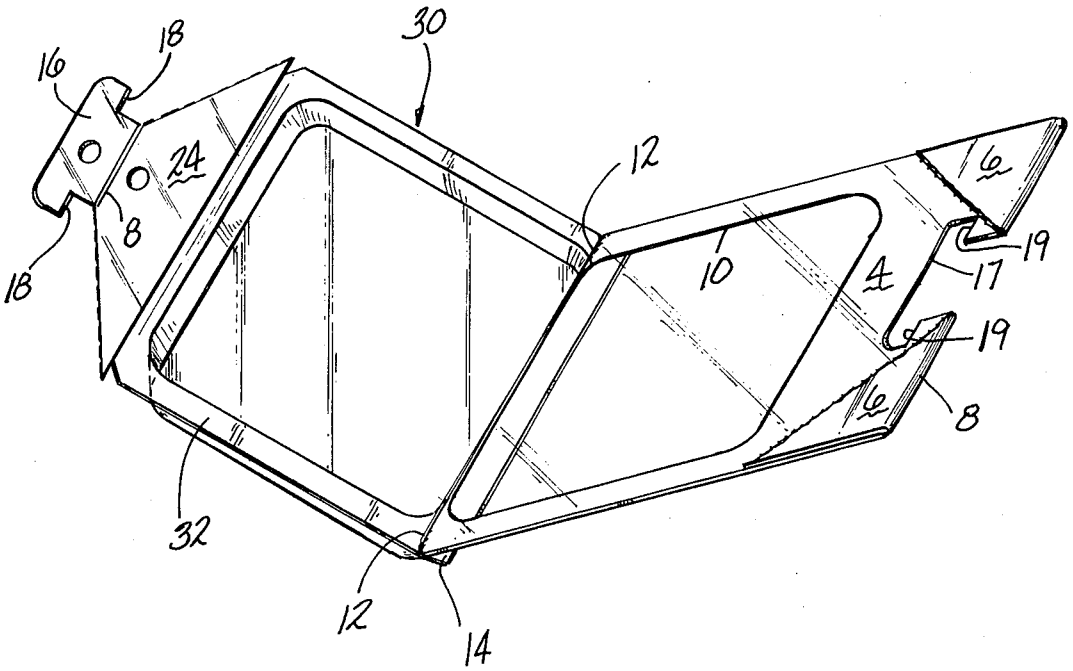
FIG. 4 is a perspective view of the package as it appears when opened to remove contents therefrom.

To open the package, one grasps the latching tab and pulls it away from the back panel 4 causing rupture of the score lines 22 and nicks on the tab. This leaves a complementarily shaped latching slot in the upper margin of the back panel. The latching tab 16 is then pivoted about the fold line 8 and is pulled away from the graphics and hanger panel 6 so as to cause rupture of the cut score lines 26. This disconnects the tear out panel 24 from the graphics and hanger panel 6, and once disconnected therefrom, continued pulling on the latching tab 16 causes the blister 30 to peel away from the back panel 4 along three legs of the blister flange 32. This is due to the non-peelable securement of the lower edge of the tear out panel 24 to the front surface of the upper leg of the blister flange 32. The lower leg of the blister flange 32 remains secured to the hinge panel 14. When the blister flange 32 has peeled away from the back panel 4 down to the fold lines 12, the blister 30 and hinge panel 14 will then pivot away from the remainder of the package, and the package will be opened as shown in FIG. 4. To reclose the package, the tear out panel 24 is moved back to its original position face-to-face with the back panel 4. The latching tab 16 is then bent about the fold line 8 and inserted into the latching slot 17 with the ears 18 being tucked behind shoulders 19 formed in the latching slot. The package is thus effectively reclosed and can be used to store unused portions of its contents.

It will be appreciated that the package of this invention will provide for improved graphics and, despite having a paperboard component, can be made in an hermetically sealed form. The package can be opened and reclosed any number of times without losing its storage capabilities.

Since many changes and variations of the disclosed embodiment of the invention can be made without departing from the inventive concept, it is not intended to limit the invention otherwise than as required by the appended claims.

I claim:

1. A reclosable package comprising:

(a) a paperboard member comprising a back wall, a hinge panel connected to a lower edge of said back wall along a fold line, and a hanger panel foldably connected to an upper edge of said back wall and folded down into overlapping relationship with an upper portion of said back wall;

(b) a tear-apart panel disposed within said hanger panel, said tear-apart panel being bounded laterally by rupturable cut score lines extending across said hanger panel to a lower free edge thereof; and (c) a plastic blister connected to said paperboard member, said blister including a peripheral flange, a lower portion of said blister flange being non-releasably adhesively secured to said hinge panel, an upper portion of said blister flange being non-releasably adhesively secured to a lower margin of said tear-apart panel, and the remainder of said blister flange being peelably adhesively secured to said back wall of said paperboard member.

2. The package of claim 1, further comprising a sheet of plastic material sealed to said paperboard member and covering the front surface of said back wall to render the package hermetically sealed.

3. The package of claim 1 wherein portions of said hanger panel disposed between said tear-apart panel and side edges of said hanger panel are non-releasably adhesively secured to said back wall.

4. The package of claim 1 further comprising a latching tab connected to the upper end of said tear apart panel and a latching slot formed in said back wall, said latching slot being operable to receive said latching tab to hold the package in a closed condition after the package is initially opened.

5. The package of claim 4 wherein said latching tab is formed from material of said back wall and said latching slot is formed when said latching tab is pulled away from said back wall to open the package.

* * * * *